US006039580A

United States Patent [19]

Sciarretta et al.

[11] Patent Number: 6,039,580

[45] Date of Patent: Mar. 21, 2000

[54] RF CONNECTOR HAVING A COMPLIANT CONTACT

[75] Inventors: William A. Sciarretta, Lexington; Paul Setzco, Wellesley; James D. Arangio, Saugus, all of Mass.

[73] Assignee: Raytheon Company, Lexington, Mass.

[21] Appl. No.: 09/116,839

[22] Filed: Jul. 16, 1998

[51] Int. Cl.[7] ..... H01R 9/09

[52] U.S. Cl. ..... 439/63; 333/243

[58] Field of Search ..... 333/33, 243; 439/63, 439/66, 289, 333, 581, 700

[56] References Cited

U.S. PATENT DOCUMENTS

| | | | |
|---|---|---|---|
| 5,356,298 | 10/1994 | Voss et al. | 439/63 |
| 5,364,276 | 11/1994 | Inasaka | 439/66 |
| 5,395,249 | 3/1995 | Reynolds et al. | 439/65 |
| 5,489,854 | 2/1996 | Buck et al. | 324/761 |
| 5,552,752 | 9/1996 | Sturdivant et al. | 333/243 |
| 5,599,193 | 2/1997 | Crotzer | 439/66 |
| 5,618,205 | 4/1997 | Riddle et al. | 439/581 |
| 5,631,446 | 5/1997 | Quan | 174/254 |
| 5,633,615 | 5/1997 | Quan | 333/33 |
| 5,668,509 | 9/1997 | Hoffmeister et al. | 333/33 |
| 5,675,302 | 10/1997 | Howard et al. | 333/243 |

OTHER PUBLICATIONS

D. Strack, et al., "Solder Free Interconnects for Mixed Signal (DC/ Microwave) Systems" 1996, EEE MTT–S Digest, pp. 231–234. (no month).

"High Performance Test Socket", Tecknit Interconnection Products, 129 Dermody Street, Cranford, NJ 07016, 9 pages of product information, undated.

"IDI Battery Contact Probes—Double Ended", Interconnect Devices, Inc., 5101 Richland Ave., Kansas City, KS 66106, 1 page of product information, undated.

*Primary Examiner*—Lincoln Donovan
*Assistant Examiner*—Michael C. Zarroli
*Attorney, Agent, or Firm*—Daly, Crowley, & Mofford, LLP

[57] ABSTRACT

An RF connector includes an electrical insulator having an aperture and a conductive contact disposed within the aperture and having at least one compliant, compressible end. The insulator is disposed in an aperture of a conductive support plate. When an RF element is secured to the support plate in use, the compliant end of the conductive contact is compressed against a conductive pad of the RF element. In one embodiment, the RF connector includes a compressible, conductive annular ring disposed concentrically around the compliant end of the conductive contact and adapted for being compressed against a ground pad of the RF element in use in order to effect a coaxial RF interconnection. The conductive contact may take various forms, such as a watch band pin, a Fuzz Button® or a bellows arrangement. The RF connector may include RF circuitry for interconnection to the RF element and/or may interconnect the RF element to a second RF element.

17 Claims, 6 Drawing Sheets

RF CONNECTOR HAVING A COMPLIANT CONTACT

CROSS-REFERENCE TO RELATED APPLICATIONS

Not applicable.

STATEMENTS REGARDING FEDERALLY SPONSORED RESEARCH

Not applicable.

BACKGROUND OF THE INVENTION

Radio Frequency (RF) modules often include male pin contacts for permitting electrical interconnections to be made to RF and DC/logic circuitry supported by the module. Various types of connectors are suitable for mating with such pins, including coaxial connectors. Coaxial connectors generally include a conductive outer housing containing a dielectric, with a cylindrical aperture through the dielectric capturing a mating female contact. The male pin contact, attached to the RF module, is inserted into the female contact which, together provide the center conductor of the connector. The ratio of the outer diameter of the center conductor to the inner diameter of the housing determines the impedance of the RF connection. Various mechanisms, such as screw threads, are suitable for mechanically coupling the RF connector housing to the RF module.

In many applications, such as phased-array antennas, RF modules include numerous male pin contacts, sometimes well in excess of one-thousand. Often in such applications, many RF connectors are supported by a single support structure, such as a plate or other type of holder, which is secured to the RF module.

The pins attached to an RF module are generally required to have very precise position tolerances, particularly in applications in which many RF connectors are supported by a single support structure. This is because tolerance variations are compounded when many RF connectors are supported in fixed positions relative to one another. Another critical parameter of the pins is that they extend from the RF module at a precise ninety-degree angle in order to ensure proper alignment with the respective RF connector during assembly. Assembly of an RF module to one or more RF connectors is time consuming due to the frailty of the pins and the conventional arrangement of including several RF pins, often closely spaced, on the module. Any tolerance variations can result in broken or bent pins, which may require that the entire RF module be replaced, thereby causing the yield of RF modules, which are often complex and expensive themselves, to suffer. Pins are often attached to an RF module by a brazing or soldering process, which tends to be rather expensive, particularly when strict tolerance requirements exist.

BRIEF SUMMARY OF THE INVENTION

The invention is directed to an RF connector comprising an electrical insulator having an aperture and a conductive contact having at least a portion disposed within the aperture of the insulator. The conductive contact has at least one compliant end adjacent to an end of the aperture for contacting a conductive pad of an RF element, such as an RF module or RF connector, in use. The conductive contact end is compliant in the sense that it is compressible. In use, the compliant end of the conductive contact is compressed against the conductive pad of the RF element to effect electrical connection. The compliant end of the conductive contact may or may not extend through the adjacent end of the insulator aperture.

A conductive support is provided for supporting one or more RF connectors of the type described above and for providing a ground connection to the RF element. One such support is provided in the form of a conductive plate and includes a plurality of apertures, each of which has an RF connector, comprising an electrical insulator and a conductive contact, disposed therein.

In use, the support is secured to the RF element, thereby causing the compliant end of each supported conductive contact to be compressed against a respective conductive pad of the RF element and causing the support to contact a ground portion of the RF element. The ratio of the outer diameter of the conductive contact to the inner diameter of the support aperture can be varied in order to vary the impedance of the RF interconnection.

With this arrangement, an RF connector is provided which overcomes several drawbacks associated with conventional RF interconnection schemes. Significantly, the RF connector of the present invention does not require the use of male or female pins attached to the RF element to provide electrical interconnection. Rather, the RF connector contacts a conductive pad on the RF element. The elimination of pins on the RF element significantly decreases the cost and time associated with manufacturing and assembling the RF system, such as a phased array antenna which requires a significant number of RF interconnections to be made. Further, with the arrangement described herein, the volumetric space required for the RF connection can be less than is required with the use of standard coaxial connectors.

The RF element may take the form of an RF module which supports RF circuitry or a standard RF connector. Further, the RF connector of the present invention may or may not include RF circuitry for electrical connection to one or more RF elements. The conductive contact has a second end adapted for contacting the second RF element, which second end may or may not be compliant.

The conductive contact may take various forms suitable for providing at least one compliant end. As one example, the conductive contact includes a "watch band" or "POGO" pin, comprising at least one spring-loaded pin capable of being compressed. In a further embodiment, the conductive contact includes a bellows device comprising a plurality of deformable folds which are compressible. A further suitable conductive contact includes a Fuzz Button® which comprises a conductor formed into a plug-shaped compressible mesh. Alternatively, the conductive contact may include Belleville washers or an element comprised of an elastomer loaded with conductive particles. Preferably, the conductive contact is plated with gold in order to ensure low, stable RF losses in benign or adverse environments.

The conductive contact may comprise a single element of one of the above-described, or other types suitable for providing at least one compliant end or, alternatively, may comprise more than one element, in which case at least one of the elements has at least one compliant end which provides the composite contact with at least one compliant end. As one example of a composite contact, a conductive contact includes a Fuzz Button® element sandwiched between two rigid conductive plugs. In this case, the exposed ends of the conductive plugs are rendered compliant because they are capable of being compressed due to compression of the sandwiched Fuzz Button® element.

The RF connector of the present invention may include an "outer" conductive member electrically insulated from the "center" conductive contact by the electrical insulator. In use, the outer conductive member simultaneously contacts a ground pad of the RF element when the compliant end of the center conductive contact is compressed against the conductive pad of the RF element. In one embodiment, the ground pad of the RF element is substantially annular and is disposed concentrically around the center conductive pad of the RF element and the conductive member of the RF connector is provided in the form of a compressible annular ring, or o-ring, in order to provide an RF coaxial interconnection.

Also described is a method of making an RF connection which includes the steps of providing an electrical insulator with an aperture, providing a conductive contact having at least one compliant end, and inserting the conductive contact into the aperture of the electrical insulator with the compliant end adjacent to an end of the aperture. Also provided is a support having an aperture in which the electrical insulator is disposed and a conductive compressible outer ground pad. In use, the support is secured to an RF element having a conductive pad, with the compliant end of the conductive contact compressed against the conductive pad and the compressible outer ground pad compressed against a ground portion of the RF element.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
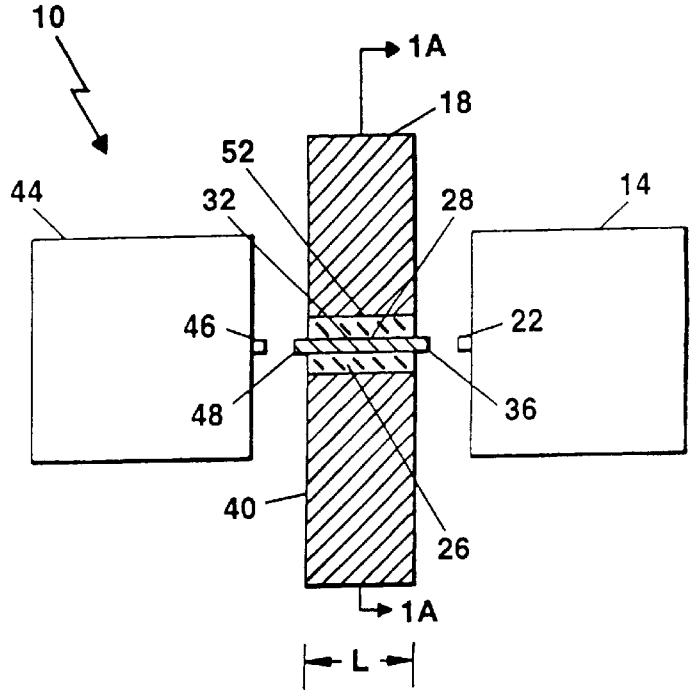
FIG. 1 shows an RF system including an RF connector according to the invention.

Referring to FIG. 1, an RF system 10 includes an RF element 14 and an RF connector 18. The RF element 14 may take various forms and be provided for various RF applications, including RF modules, such as T/R modules for radar systems, and standard RF connectors. In general, the RF element 14 carries one or more RF signals to be electrically connected to RF circuitry which may or may not be contained within the element 14. An RF element in the form of an RF module generally contains RF circuitry, whereas an RF element in the form of a standard RF connector generally carries electrical signals to a further module. The RF element 14 may additionally carry one or more DC/logic signals to circuitry which may or may not be contained within the element. Some RF modules 14 include microstrip, stripline, and/or coaxial RF transmission lines, often provided on a multilayered ceramic structure (see, for example, FIGS. 3, 4 and 6).

The RF connector 18 in FIG. 1 provides electrical connection to the RF element 14 without requiring that the element have pins attached thereto. Rather, the RF element 14 generally includes at least one conductive pad 22 and a ground portion for purposes of permitting a coaxial electrical connection to be made to the element. Often, the RF element 14 includes a plurality of pads 22 carrying RF and/or DC/logic signals for electrical connection to RF circuitry. The RF connector 18 will be described in conjunction with making a single RF connection to a single conductive pad 22 on the element 14 for simplicity of illustration. However, it will be appreciated by those of ordinary skill in the art that the RF connector 18 may be modified to provide RF and/or DC/logic connections to a plurality of conductive pads on the element.

The RF connector 18 includes a dielectric, or electrical insulator 26 having a bore, or aperture 28 therethrough and a conductive contact 32 disposed through at least a portion of the aperture 28. The conductive contact 32 has at least one compliant end 36 which is capable of being compressed in use, as described further below. The compliant end 36 of the conductive contact 32 may extend through the adjacent end of the aperture 28 as shown, or alternatively, may terminate within the aperture.

A conductive support 40 is provided for supporting the electrical insulator 26 and conductive contact 32 and for providing a ground connection to the RF element 14. More particularly, the support 40 has an aperture 52 adapted to receive the electrical insulator 26, as shown.

Figure 1A:
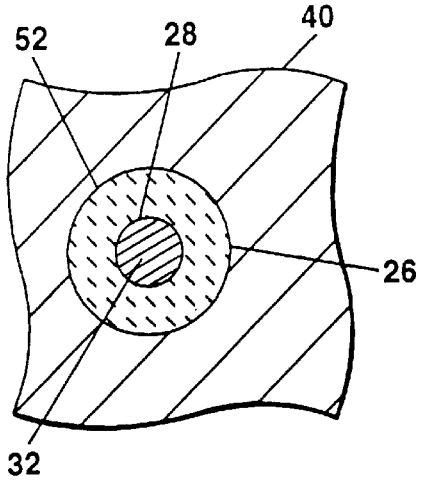
FIG. 1A is a cross-sectional view of the RF connector of FIG. 1.

Referring also to FIG. 1A, a cross-sectional view of a portion of the RF connector 18 taken along line 1A—1A of FIG. 1 reveals that both the insulator 26 and contact 32 have substantially circular (i.e., coaxial) cross-sectional shapes. However, as will be appreciated to those of ordinary skill in the art, other cross-sectional shapes for both the electrical insulator 26 and the conductive contact 32 are possible without departing from the spirit and scope of the invention. The impedance of the RF connection provided by the connector 18 is a function of the ratio of the outer diameter of the conductive contact 32 to the inner diameter of the aperture 52 in the support 40.

The connector 18 may electrically connect the RF element 14 to circuitry provided as part of the connector 18 (not shown) and/or may electrically connect the RF element 14 to a second RF element 44, as shown. Like the first RF element 14, the second RF element 44 carries one or more RF and/or DC/logic signals to be electrically connected to circuitry which may or may not be contained within the element 44 and typically takes the form of an RF module or a standard RF connector. A second end 48 of the conductive contact 32 which contacts the second RF element 44 in use may or may not be compliant and may or may not extend through the adjacent end of the insulator aperture 28. In the embodiment of FIG. 1, the second end 48 of the contact 32 is compliant and extends through the adjacent end of the aperture 28.

The conductive contact 32 may take various forms in order to provide the characteristic of having at least one compliant, compressible end. One suitable conductive contact, shown in FIG. 1, is a Fuzz Button® which is a generally cylindrical element comprising one or more conductors formed into a plug-shaped mesh. The Fuzz Button® is comprised of materials such as phosphor-bronze, molybdenum and beryllium copper plated with nickel or gold. Fuzz Button® is a registered trademark of Tecknit® of Cranford, N.J. Other suitable conductive contact elements and combinations of elements are described below.

The electrical insulator 26 may be comprised of any dielectric material having suitable dielectric and mechanical characteristics, such as plastics, ceramics or Teflon®, and may be fabricated by various techniques, including molding. Generally, the material of the insulator 26 is selected to provide a predetermined dielectric constant as a function of the frequency of the RF signals carried by the connector.

The conductive support 40 which provides the ground connection for the resulting coaxial connection may take various forms, such as the plate shown in FIG. 1, and may be comprised of various conductive materials. As one example, the support 40 is comprised of aluminum and the aperture 52 is formed by drilling.

Various techniques are suitable for assembling the RF connector 18 of FIG. 1. For example, the electrical insulator 26 may be press fit into the aperture 52 of the support 40. Alternatively, an adhesive may be used to secure the insulator 26 within the aperture 52. However, easily reversible assembly techniques, such as press fitting, may be preferable due to ease of disassembly for testing, manufacturing and repair purposes.

In the illustrative embodiment, the conductive contact 32 is "light" press fit into the aperture 28 of the electrical insulator 26. In some applications, it may be desirable to taper the aperture 28 of the insulator 26 in order to facilitate this press fit relationship. The technique chosen for securing the conductive contact 32 within the aperture 28 of the insulator must permit at least one end portion (i.e., the compliant end) of the contact to be free-moving relative to the insulator 26 in order to permit compression in use. Here again, easily reversible assembly techniques, such as press fitting, may be preferable due to ease of disassembly for testing, manufacturing and repair purposes.

In use, the RF connector 18 is aligned with, and secured to the RF element 14 such that the first compliant end 36 of the conductive contact 32 is compressed against the conductive pad 22 of the element 14 and at least a portion of the conductive support 40 contacts a ground portion of the RF element. The RF connector 18 may be secured to the RF element 14 by various mechanisms (not shown), such as screws, clamps and/or epoxy.

In applications in which the RF connector 18 interconnects the first RF element 14 with a second RF element 44 as shown in FIG. 1, the second RF element 44 and the RF connector 18 are likewise secured together, thereby causing the second compliant end 48 of the conductive contact 32 to be compressed against a conductive pad 46 of the second RF element 44 and a portion of the conductive support 40 to contact a ground portion of the RF element 44.

Figure 2:
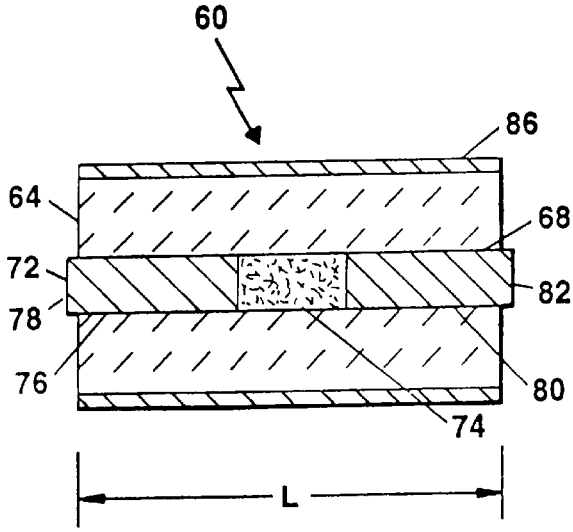
FIG. 2 shows an alternate RF connector according to the invention.

Referring to FIG. 2, an alternate RF connector 60 includes an electrical insulator 64 having an aperture 68 therein in which a conductive contact 72 is disposed. The conductive contact 72 may be comprised of more than one conductive element. In the embodiment of FIG. 2, the conductive contact 72 includes a Fuzz Button® element 74, a first, rigid conductive plug 76 terminating at a first compliant end 78 of the contact and a second, rigid conductive plug 80 terminating at a second compliant end 82 of the contact.

In use, the RF connector 60 is disposed between RF elements 14, 44 (FIG. 1) to provide electrical interconnection therebetween in the same manner as described above in conjunction with FIG. 1. More particularly, when the RF connector 60 is secured between elements 14 and 44, the end 78 of plug 76 is urged inward toward the Fuzz Button®, thereby compressing the Fuzz Button® and the end 82 of the plug 80 is urged inward toward the Fuzz Button®, thereby further compressing the Fuzz Button®. In this way, the compressibility of the Fuzz Button® 74 is effectively transferred to the plugs 76, 80 rendering the first and second ends 78, 80 of the composite conductive contact 72 compliant.

The RF connector 60 further includes a conductive support 86. In the embodiment of FIG. 2, the support 86 is provided in the form of a relatively thin conductive sheath covering the dielectric 64. As will be appreciated by those of ordinary skill in the art, the support may take various forms having various dimensions. In use, at least a portion of the conductive support 86 contacts a ground portion of the RF elements to thereby effect a coaxial RF connection.

Figure 3:
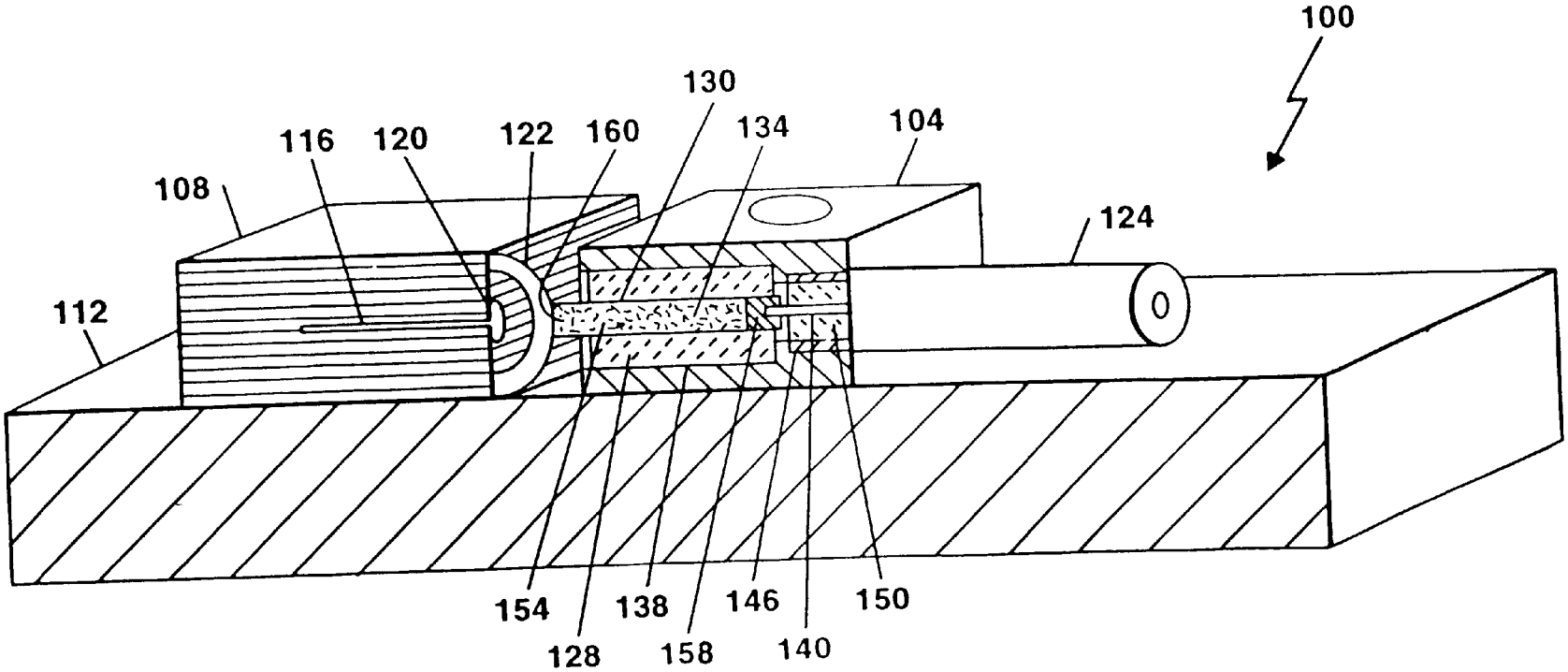
FIG. 3 shows an RF system including an alternate RF connector according to the invention.

Referring to FIG. 3, an RF system 100 includes an RF connector 104 suitable for providing electrical interconnection to an RF element 108. The RF connector 104 and RF element 108 are disposed over a floor 112 of a structural housing member or heat sink (not shown) in which the RF system 100 is disposed. In the embodiment of FIG. 3, the RF element 108 is provided in the form of an RF module.

The RF element 108 includes a horizontally oriented multilayered ceramic structure supporting a strip transmission line 116 having an electrically isolated conductive pad 120 disposed on an edge of the element 108 adjacent to the RF connector 104. The ground plane of the strip transmission line 116 is provided by the RF element housing floor 112 and is electrically connected to a ground pad 122 disposed concentrically around the conductive pad 120 for contacting a ground plane of the RF connector 104. It should be noted that RF element 108, may have a variety of internal configurations and of particular relevance are the external features of conductive pad 120 and ground pad 122.

In the embodiment of FIG. 3, the RF connector 104 is provided as part of a coaxial cable mounting block. To this end, the connector 104 includes a coaxial cable 124 having a center conductor 140 electrically insulated from a ground shield 146 by an electrical insulator 150, as shown. The RF connector 104 provides electrical interconnection between the RF element 108 and the coaxial cable 124 extending from the RF connector.

The RF connector 104 includes an electrical insulator 128 having an aperture 130 in which a conductive contact 134 is disposed. The electrical insulator 128 is, in turn, disposed in an aperture 138 of the connector 104.

The conductive contact 134 includes a Fuzz Button® element 152 and a conductive cap 158. The Fuzz Button® 154 extends through an end of the aperture 130 to terminate it a compliant end 160. The opposite end of the Fuzz Button® 154 is disposed in contact with the conductive cap 158. The conductive cap 158 includes a detent having a size and shape complementary to the center conductor 140 of the coaxial cable 124. In assembly, the tip of the coaxial cable center conductor 140 is disposed in the detent of the cap 158, as shown.

In use, the RF connector 104 and the RF element 108 are secured together by any of various conventional mechanisms. With the connector and element secured together, the exposed end 160 of the Fuzz Button® 154 is compressed against the pad 120 of the RF element. Further, the opposite end of the Fuzz Button® element is compressed against the conductive cap 158, thereby electrically connecting the coaxial cable 124 to the strip transmission line 116 via the Fuzz Button® 154 and the conductive cap 158. The ground path in the embodiment of FIG. 3 is provided by the RF element housing floor 112 in contact with ground pad 122 which, in assembly, contacts a ground pad of the RF connector 104.

Figure 4:
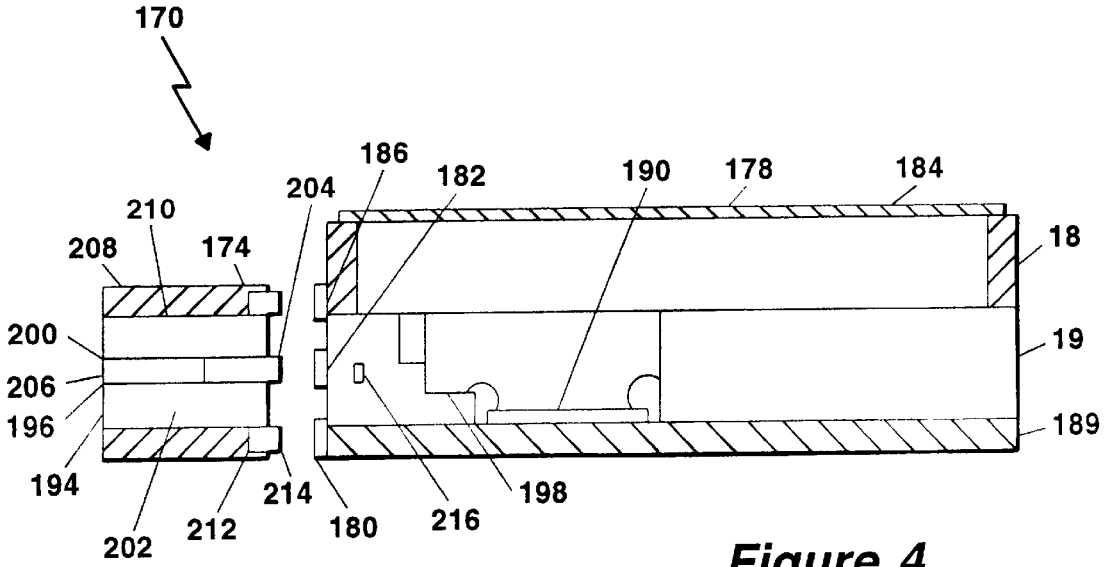
FIG. 4 shows an RF system including a further alternate RF connector according to the invention.

Referring to FIG. 4, a further alternate RF system 170 includes an RF connector 174 and an RF element 178. The RF element 178 is provided in the form of an RF module and includes a horizontally oriented ceramic structure 192. The element 178 supports a strip transmission line including a ground plane and a conductor 198 connected by a via 216 to a monolithic microwave integrated circuit (MMIC) 190 housed within the element 178. The ground plane is provided by a housing cover 184, housing walls 188, and a housing floor 189 of the element 178. The conductor 198 and ground plane are accessible via conductive pads 182 and 186, respectively, disposed on an end 180 of the element, with the ground pad 186 having a substantially annular shape and being disposed concentrically around the conductor pad 182 in the form of a coaxial transmission line. It will be appreciated by those of ordinary skill in the art that the pads 182 and 186 can be eliminated if the adjacent portions of the RF element housing are plated with gold or silver.

The RF connector 174 includes an electrical insulator 194 having an aperture 196 in which a conductive contact 200, comprising a contact 202 and a Fuzz Button® 204, is disposed. The RF connector 174 further includes a support 208 providing an outer conductor and having an aperture 210 in which the electrical insulator 194 is disposed, as shown.

A compliant conductive member 214 is disposed concentrically around the Fuzz Button® 204. The compliant conductive member 214 is electrically isolated from the Fuzz Button® 204 by the electrical insulator 194, as shown.

In the illustrative embodiment, the compliant conductive member 214 is provided in the form of a conductive annular ring. The conductive member 214 may be comprised of various compressible, conductive materials, including silicone loaded with conductive particles such as aluminum, silver, or gold, and gold-plated wire mesh like the materials used in the Fuzz Button® 204.

Various techniques are suitable for securing the annular conductive member 214 to the RF connector 174. In the illustrative embodiment, the support 208 has a groove 212 in which the annular conductive member 214 is seated. The annular member 214 may be held in place in the groove 212 by any suitable technique, such as a friction, or press fit arrangement or with the use of an adhesive.

In use, the RF connector 174 and the RF element 178 are secured together, with the annular conductive member 214 and the Fuzz Button® 204 concentrically aligned with the conductor pad 182. With this arrangement, the Fuzz Button® 204 is compressed against the conductor pad 182 and the annular conductive member 208 is compressed against the housing ground plane via ground pad 186, thereby effecting a coaxial RF connection.

The contact 200 has a first end in contact with the Fuzz Button® 204 and a second end 206 provided in the form of a female socket or a male pin capable of accepting a standard RF connector of the opposite type.

Figure 5:
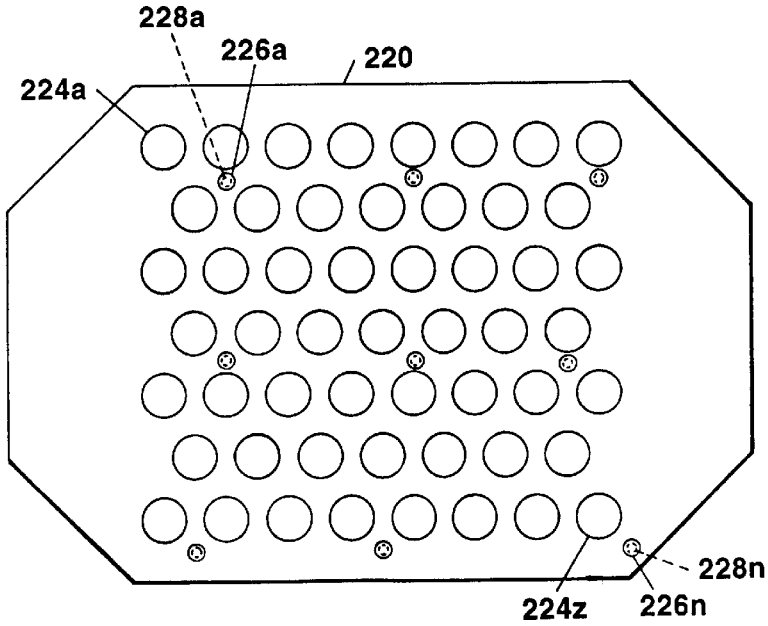
FIG. 5 is a plan view of a support plate suitable for supporting a plurality of RF connector.

Referring to FIG. 5, an illustrative conductive support plate 220 for use with an RF connector of the type described herein is shown to include a plurality of apertures 224*a*–224*z*. The support plate may be comprised of any material having a conductively plated (anti-corrosive) surface exhibiting suitable strength characteristics, such as steel. Further, the plate 220 may include any number of apertures 224*a*–224*z* arranged in various patterns suitable for accommodating RF interconnection to conductive pads on one or more RF elements.

Each of the apertures 224*a*–224*z* is adapted for receiving an electrical insulator and conductive contact arrangement, such as of the type described above in conjunction with FIGS. 1–4. As noted above, the electrical insulators may be held in place in the apertures 224*a*–224*z* by various mechanisms, including a press fit arrangement.

In use, one or more RF elements are secured to the plate 220, as described above. Various mechanisms are suitable for providing this mechanical interconnection, such as the use of screws 126*a*–126*n* disposed through screw holes 228*a*–228*n* as shown, or with epoxy and/or clamps. The particular number, size and location of the screw holes 228*a*–228*n* or other mounting mechanism is a function of the particular application.

Figure 6:
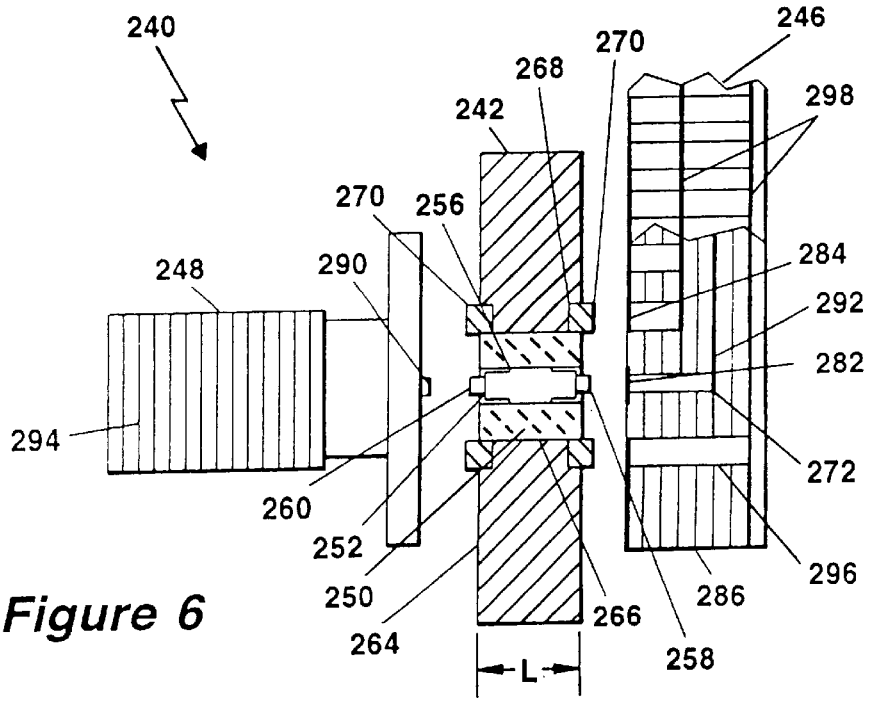
FIG. 6 shows an RF system including an RF connector utilizing a watch band pin as the conductive contact.

Referring to FIG. 6, a further alternate RF system 240 includes an RF connector 242 interconnecting a first RF element 246 provided in the form of an RF module and a second RF element 248 provided in the form of a standard coaxial connector. The RF connector 242, like those described above, includes an electrical insulator 250 having an aperture 252 in which a conductive contact 256 is disposed. The conductive contact 256 of FIG. 6 is provided in the form of a "watch band" pin, which is sometimes referred to as a "POGO" pin, as will be described. Suffice it to say that the conductive contact 256 has first and second compliant, compressible ends 258, 260.

The RF connector 242 further includes an outer conductor element, or support plate 264 having an aperture provided in the form of a machined hole 266 through which the electrical insulator 250 is disposed. Also provided are two substantially annular, compressible conductive members 270, like the annular ring 214 of FIG. 4, disposed in grooves 268 of the plate 264 and electrically isolated from the conductive contact 256 by the insulator 250, as shown.

The RF element 246 includes a multilayered ceramic structure 286 supporting a transmission line 292 and ground planes 298 arranged to provide a 50 ohm strip transmission line. Although RF element 246, RF connector 242, and RF element 248 are shown to be vertically oriented, it will be appreciated by those of ordinary skill in the art that the entire assembly can be rotated by ninety degrees in use in order to render the multilayered structure 286 horizontally oriented. A conductive pad 282 is electrically connected through a via 272 to the strip transmission line 292 and a ground pad 284 is electrically connected through vias 296 to the ground planes 298. The ground pad 284 is substantially annular and is disposed concentrically around the conductor pad 282 in the form of a coaxial transmission line. The coaxial RF connector element 248 has a center conductor 290 and threads 294 for connection to other RF elements, connectors and/or circuitry (not shown).

Figure 6A:
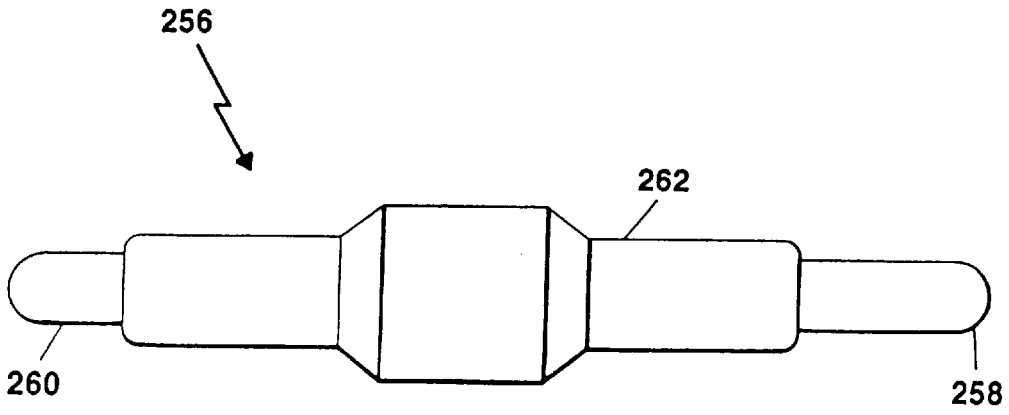
FIG. 6A is an enlargement of the watch band pin conductive contact of the RF connector of FIG. 6.

Referring to the watch band pin enlargement of FIG. 6A, the pin 256 includes a housing 262 sized and shaped for being inserted into the aperture 252 of the electrical insulator 250. At least one, and in the illustrative embodiment both ends 258, 260, of the contact 256 are spring-loaded and thus, are capable of being compressed. Suitable watch band pins are available from Interconnect Devices, Inc. of Kansas City, Kans. under part numbers 100404-00 and 100422-00. In use, when the RF element 246 and coaxial RF connector 248 are secured to the RF connector 242, the first end 258 of the contact 256 is compressed against the center conductor 282 of the RF element 246 and the second end 260 of the contact 256 is compressed against the center conductor 290 of the coaxial RF connector element 248. Further, the compressible annular ring 268 is compressed against the ground pad 284 of the RF element 246.

Figure 7:
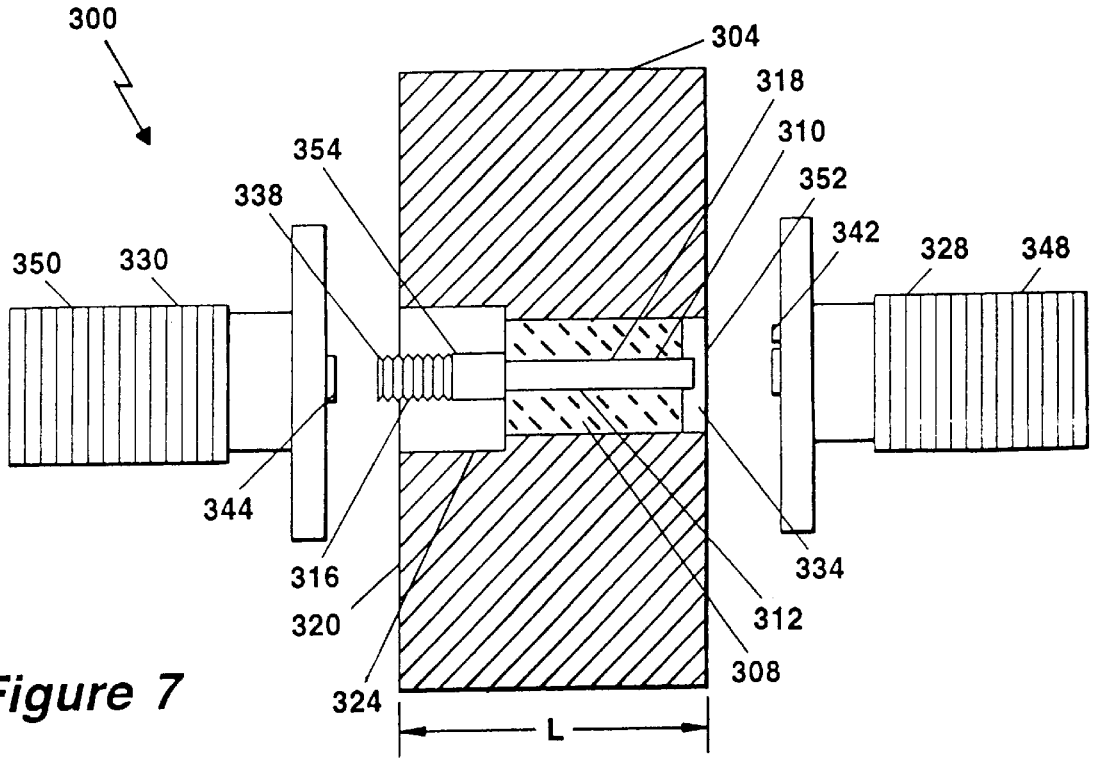
FIG. 7 shows an RF system including an RF connector utilizing a bellows as part of the conductive contact.

Referring to FIG. 7, another alternate RF system 300 includes an RF connector 304 having an electrical insulator 308 with an aperture 310 in which a conductive contact 312 is disposed. The conductive contact 312 includes an integral compressible bellows 316, as will be described. The RF connector 304 further includes a support plate 320 having an aperture 324 in which the electrical insulator 308 is disposed.

The RF connector 304 is adapted for interconnecting first and second RF elements 328, 330 which, in the embodiment of FIG. 7, are provided in the form of standard RF connectors. Each of the RF elements 328, 330 shown in FIG. 7 thus includes a center conductor 342, 344 and a threaded portion 348, 350 for connection to other RF elements, connectors and/or circuitry (not shown), respectively.

The conductive contact 312 has a first end 334 adapted for contacting the center conductor 342 of the first RF element 328 in use and a second, compliant end 338. More particularly, the conductive contact 312 includes a bellows 316 and a conductive pin 318, with the conductive pin 318 disposed within the aperture 310 of the insulator 308. One end 334 of the conductive pin 318 terminates slightly beyond an end of the insulator 308 in a gap 352 between the end of the insulator and the edge of the plate 320 adjacent to the RF element 326. The bellows 316 is at the opposite end of the pin 318 and extends through a portion 354 of the aperture 324, to terminate beyond the edge of the plate 320 adjacent to the RF element 330, as shown.

Figure 7A:
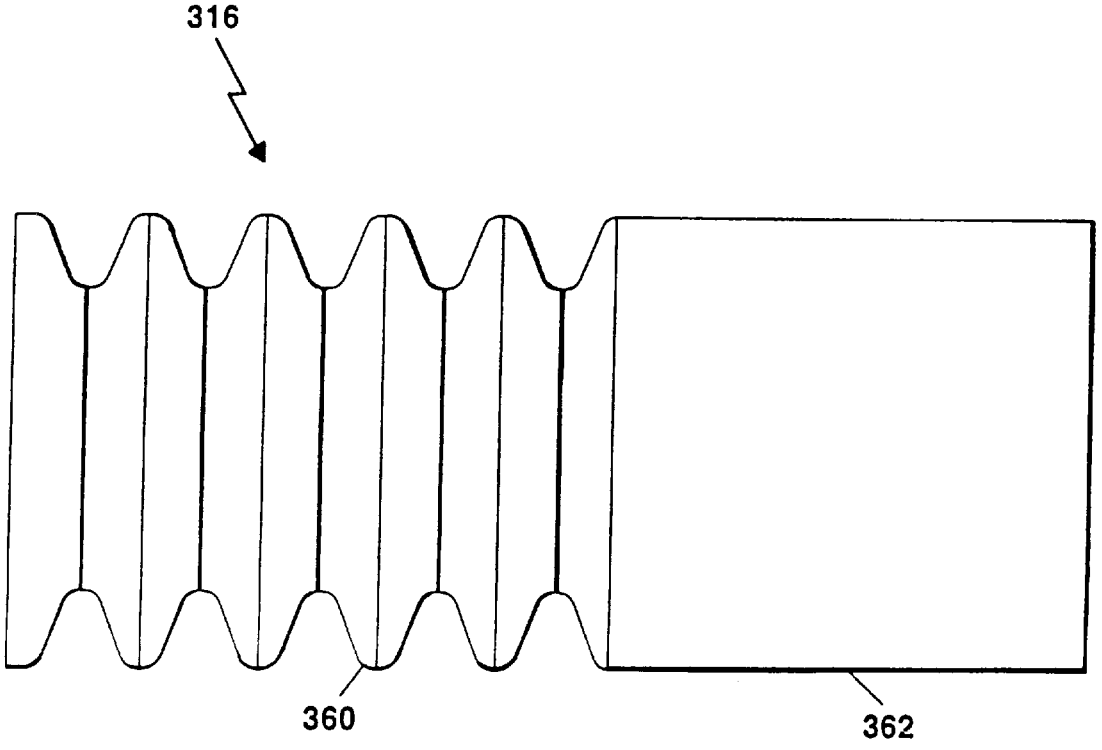
FIG. 7A is an enlargement of the bellows conductive contact of the RF connector of FIG. 7.

Referring to the enlargement of the bellows in FIG. 7A, the bellows 316 is comprised of a flexible accordion section 360 integrally formed with and extending from a hollow cap section 362. The accordion section 360 comprises a plurality of flexible folds which are compressible against one another. The bellows may be comprised of various flexible, conductive materials, such as silver or gold plated nickel, by any suitable technique such as electroforming. Suitable bellows devices are available from Servometer Corporation of Cedar Grove, N.J. under the part number 2510.

In assembly, the end of the pin 318 adjacent to the bellows is inserted into the hollow cap 362 of the bellows and secured in place by any suitable joining process, such as soldering or spot welding. It will be appreciated by those of ordinary skill in the art however, that other schemes are suitable for coupling the bellows to the pin 318. The resulting conductive contact 312, including the bellows 316 and the conductive pin 318, is inserted into the insulator aperture 310 with a "slide-fit" arrangement.

In use, the RF connector 304 is brought into alignment with the RF elements 328, 330 such that the center conductor 344 of the RF element 330 is aligned with the end 338 of the bellows 316 and the center conductor 342 of the RF element 328 is aligned with the end 334 of the conductive pin 318. The RF elements 328, 330 and the RF connector 304 are secured together by any suitable mechanism, thereby causing the bellows 316 to compress against the conductor 344, causing the conductor 342 to contact to the end 334 of the conductive pin 318 and causing the conductive support 320 to contact ground portions of the RF elements 328 and 330.

Figure 8:
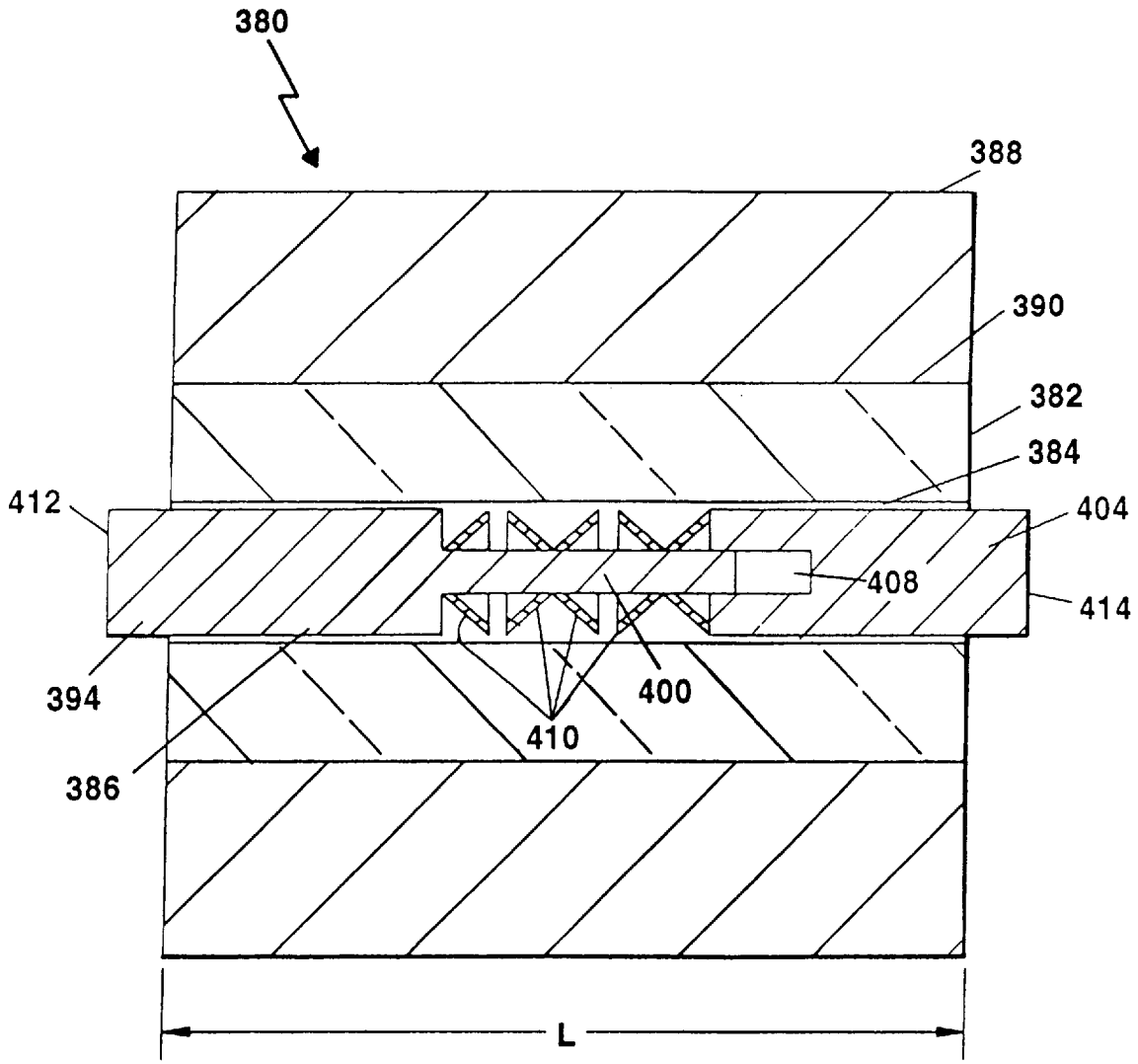
FIG. 8 shows a further alternate RF connector utilizing Belleville washers as part of the conductive contact.

Referring to FIG. 8, an alternate RF connector 380 includes an electrical insulator 382 having an aperture 384 in which a conductive contact 386 is disposed. The conductive contact 386 has first and second compressible, sliding ends 412, 414, respectively. The connector 380 further includes a conductive support plate 388 having an aperture 390 in which the electrical insulator 382 is disposed, as shown.

The conductive contact 386 includes a first member 394 having a post 400 extending therefrom and a second portion 404 having a detent 408 therein. The post 400 and detent 408 are sized and shaped to permit an end of the post 400 to slide fit within the detent 408, as shown. A plurality of compressible elements 410 are disposed on the post 400. In the illustrative embodiment, the compressible elements 410 are provided in the form of Belleville washers or bellows. The number, size and material of the elements 410 are selected to provide a predetermined spring constant to suit a particular application. The conductive contact 386 is disposed in the insulator aperture 384 with a "slide-fit" arrangement.

In use, the RF connector 380 is adapted for being positioned between two RF elements in order to provide electrical connection therebetween in the manner described generally above in connection with FIG. 1. That is, the RF connector 380 is secured to the RF elements such that the exposed end 412 of the connector portion 394 is compressed against a conductive pad of one of the elements and the exposed end 414 of the connector portion 404 is compressed against a conductive pad of the other one of the elements, thereby compressing the Belleville washers 410. Further, the conductive support 388 contacts ground portions of the RF elements in order to effect an RF coaxial connection.

It will now be apparent to those of ordinary skill in the art that the RF connectors described herein overcome several drawbacks associated with conventional RF interconnection schemes. Significantly, the RF connectors described herein provide electrical connection to one or more conductive pads, rather than to pins. The elimination of pins on RF elements reduces the manufacturing, assembly and repair costs of the RF elements and, further, increases the yield of such elements.

Further, the cross-sectional length "L" (FIGS. 1–2 and 6–8) and, thus, the volume of the RF connectors described herein can be smaller than heretofore possible since there are no minimum length requirements imposed by pins extending from the RF element. Further, a single screw or other securing mechanism, through the support (e.g., support 40 of FIG. 1) can provide sufficient coupling force to mate many connectors, such as on the order of ten. Thus, the space required around each conductive contact is less than would be required for individual screw thread coupling mechanisms. In particular, the cross-sectional length "L" and volume of the RF connector is dictated only by the availability of conductive contact elements of small dimensions and manufacturing considerations regarding handling and assembly of the connector. For example, Fuzz Button® embodiment of FIG. 1, the cross-sectional length "L" of the connector 18 may be on the order of 0.050 inches.

These advantages are achieved with the use of a compliant, compressible member as, at least part of, the conductive contact of the RF connector. As described herein, various element types and combinations thereof are possible for providing the conductive contact and are within the spirit and scope of the present invention. Significant to the suitability of the connector arrangements described herein to making RF interconnections is the plating, of the conductive contact in order to minimize insertion and return losses and the ability to tailor the impedance of the RF interconnection by varying the ratio of the conductive contact outer diameter to the inner diameter of the aperture in the conductive support in which the insulator is disposed. Further, as will be apparent to those of ordinary skill in the art, the connectors described herein may be used to provide connection to DC/logic signals in addition to RF signals.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims. All publications and references cited herein are expressly incorporated herein by reference in their entirety.

What is claimed is:

1. An RF system comprising:

an RF element having at least one conductive pad and a ground pad; and an RF connector comprising:

a conductive support having at least one aperture;

an electrical insulator disposed within said aperture of said conductive support and having an aperture, a conductive contact having a portion disposed within said aperture of said electrical insulator and a compliant end adjacent to an end of said aperture and capable of being compressed when said compliant end contacts said conductive pad of said RF element; and a compliant conductive member disposed concentrically around said conductive contact and electrically insulated from said conductive contact by said electrical insulator, wherein said compliant conductive member contacts said ground pad of said RF element when said compliant end of said conductive contact contacts said conductive pad of said RF element.

2. The RF system of claim 1 wherein said conductive contact comprises a selected one of a Fuzz Button®, a watch band pin, and a bellows.

3. The RF system of claim 1 wherein said conductive contact has a second end adjacent to a second end of said aperture of said electrical insulator.

4. The RF system of claim 3 wherein said second end of said conductive contact is compliant.

5. The RF system of claim 1 wherein said RF connector further comprises a securing mechanism for securing said conductive support to said RF element.

6. The RF system of claim 5 wherein said RF element has a plurality of conductive pads and said RF system comprises a plurality of said RF connectors, each comprising a conductive contact capable of being compressed when said compliant end contacts a respective one of said plurality of conductive pads of said RF element.

7. An RF system comprising:

an RF element having at least one conductive pad and a ground pad disposed adjacent to said conductive pad; and an RF connector comprising:

a conductive support having at least one aperture;

an electrical insulator disposed within said aperture of said conductive support and having an aperture;

a conductive contact having a portion disposed within said aperture of said electrical insulator and a compliant end adjacent to an end of said aperture and capable of being compressed when said compliant end contacts said conductive pad of said RF element and said conductive support contacts said RF element; and a conductive member electrically insulated form said conductive contact by said electrical insulator, wherein said conductive member contacts said ground pad when said compliant end contacts said conductive pad, wherein said ground pad of said RF element is disposed concentrically around said conductive pad and said conductive member comprises a compressible annular ring.

8. An RF connector comprising:

a substantially rigid conductive support having at least one aperture;

an electrical insulator disposed within said aperture of said conductive support and having an aperture;

a conductive contact having a portion disposed within said aperture of said electrical insulator and a compliant end adjacent to an end of said aperture and capable of being compressed when said compliant end contacts a conductive pad of an RF element; and a compliant conductive member disposed in contact with said substantially rigid conductive support and electrically insulated from said conductive contact by said electrical insulator, wherein said compliant conductive member and said substantially rigid conductive support contact a ground pad of said RF element when said compliant end of said conductive contact contacts said conductive pad of said RF element.

9. The RF connector of claim 8 wherein said conductive contact comprises a selected one of a Fuzz Button®, a watch band pin, and a bellows.

10. The RF connector of claim 8 wherein said conductive contact has a second end adjacent to a second end of said aperture of said electrical insulator.

11. The RF connector of claim 10 wherein said second end of said conductive contact is compliant.

12. An RF connector comprising:

a conductive support having at least one aperture;

an electrical insulator disposed within said aperture of said conductive support and having an aperture;

a conductive contact having a portion disposed within said aperture of said electrical insulator and a compliant end adjacent to an end of said aperture and capable of being compressed when said compliant end contacts a conductive pad of an RF element and said conductive support contacts said RF element;

a conductive member electrically insulated from said conductive contact by said electrical insulator, wherein said conductive member contacts a ground pad of said RF element when said compliant end contacts said conductive pad, wherein said ground pad of said RF element is disposed concentrically around said conductive pad and said conductive member comprises a compressible annular ring.

13. A method of making an RF connection comprising the steps of:

providing a conductive support having at least one aperture;

providing an electrical insulator having an aperture;

inserting said electrical insulator into said aperture of said conductive support;

providing a conductive contact having at least one compliant end;

providing a compliant conductive member disposed concentrically around said conductive contact and electrical insulated from said conductive contact by said electrical insulator;

inserting said conductive contact into said aperture of said electrical insulator with said at least one compliant end adjacent to an end of said aperture; and securing said conductive support to an RF element having a conductive pad and a ground pad, with said compliant end of said conductive contact being compressed against said conductive pad and said compliant conductive member being compressed against said ground pad.

14. The method of claim 13 wherein the step of providing a conductive contact comprises the step of providing the conductive contact to include a selected one of a Fuzz Button®, a watch band pin, and a bellows.

15. The RF system of claim 1 wherein said ground pad of said RF element is disposed concentrically around said conductive pad.

16. The method of claim 13 wherein said securing step comprises the step of securing said conductive support to an RF element having a ground pad disposed concentrically around said conductive pad.

17. An RF system comprising:

an RF element having at least one conductive pad; and an RF connector comprising:

a conductive support having at least one aperture;

an electrical insulator disposed within said aperture of said conductive support and having an aperture; and a conductive contact comprising a compliant portion disposed within said aperture of said electrical insulator and a substantially rigid portion adjacent to an end of said aperture, wherein said substantially rigid portion compresses said compliant portion when said substantially rigid portion contacts said conductive pad of said RF element wherein said compliant portion of said conductive contact comprises a Fuzz Button®.

* * * * *